United States Patent [19]

Frankel et al.

[11] 4,432,817

[45] Feb. 21, 1984

[54] PROPELLANT CONTAINING AN AZIDONITROCARBAMATE PLASTICIZER

[75] Inventors: Milton B. Frankel, Tarzana; Edward F. Witucki, Van Nuys, both of Calif.

[73] Assignee: The United States of America as represented by the Secretary of the Air Force, Washington, D.C.

[21] Appl. No.: 361,643

[22] Filed: Mar. 25, 1982

[51] Int. Cl.[3] ..... C06B 45/10

[52] U.S. Cl. ..... 149/19.5; 149/19.1; 149/88; 149/92; 260/349

[58] Field of Search ..... 149/19.1, 19.6, 19.5, 149/19.91, 88, 94, 92; 260/349

[56] References Cited

U.S. PATENT DOCUMENTS

| | | | |
|---|---|---|---|
| 3,576,840 | 4/1971 | Frankel | 149/88 |
| 3,850,978 | 11/1974 | Gilligan et al. | 149/88 |
| 4,001,191 | 1/1977 | Reed | 149/19.91 |
| 4,141,910 | 2/1979 | Flanagan et al. | 149/88 |
| 4,268,450 | 5/1981 | Frankel et al. | 149/19.6 |
| 4,341,712 | 7/1982 | Frankel et al. | 149/88 |

*Primary Examiner*—Edward A. Miller

*Attorney, Agent, or Firm*—Donald J. Singer; William J. O'Brien

[57] ABSTRACT

This invention involves the synthesis of a novel family of azido nitrocarbamates and their utilization as energetic liquid plasticizers for advanced solid propellant compositions. The novel family of plasticizers is represented specifically by the novel compound, 1,3-diazido-2-propyl-N-nitro-N-trinitropropyl carbamate.

1 Claim, No Drawings

PROPELLANT CONTAINING AN AZIDONITROCARBAMATE PLASTICIZER

STATEMENT OF GOVERNMENT INTEREST

The invention described herein may be manufactured and used by or for the Government for governmental purposes without the payment of any royalty thereon.

BACKGROUND OF THE INVENTION

This invention relates to solid propellant compositions and to a novel family of energetic liquid plasticizers for use therewith. In a more specific aspect, this invention concerns itself with the use of a novel family of azidonitrocarbamates as energetic plasticizers for advanced solid propellant compositions. In still another specific aspect, this invention concerns itself with the use of azidonitrocarbamates as a means of reducing or minimizing the amount of smoke in the exhaust gases generated during the propulsion phase of solid propellants.

The increased utilization of rockets and missiles has spawned a considerable research effort in an attempt to improve the performance characteristics of solid propellent compositions. Generally, solid propellants consist of one or more organic or inorganic oxidizers dispersed in a resinous binder matrix which may also function as a fuel. Typical oxidizers are ammonium perchlorate or HMX (cyclotetramethylene tetranitramine) which are well known in the art. Various resinous components, such as hydrocarbons, polyesters, polyurethanes and other like materials may serve as the binder/fuel matrix. A supplemental fuel component, such as finely powered aluminum, may be used also. Other additive components, such as anti-oxidants, burning rate modifiers, wetting agents, anti-foaming agents and plasticizers may be added to the propellant composition, if desired. Dibutylphthalate or triacetin are generally employed as inert plasticizers in combination with the resinous binder material.

In using solid propellants, however, a problem exists in that an undesirable amount of smoke is often produced in the exhaust gases emanating from the solid rocket motor during propulsion. Excessive amounts of smoke are extremely undesirable in the exhaust gases since this provides data which pinpoints the sites from which the missiles or rockets are being fired. During previous efforts at overcoming the problem of excessive smoke, it was suggested that HMX be utilized as the oxidizer component since ammonium perchlorate liberates hydrochloric acid as a primary exhaust product. The acid is a strong smoke producer. Although the use of HMX as an oxidizer tended to reduce the amount of smoke produced in the exhaust gases, its use did not sufficiently overcome the problem and telltale amounts of smoke were still produced.

As a consequence, a continuing research effort was maintained since there still existed a need for a solid propellant with a minimum amount of smoke in its exhaust gases coupled with performance characteristics as good or better than solid propellants that have excessive amounts of smoke in their exhaust gases. In furthering the research effort referred to above, it was unexpectedly discovered that a new family of azidonitrocarbamates could be employed as energetic plasticizers in the fabrication of an energetic smokeless propellant. The novel plasticizers of this invention replace the conventional triacetin inert plasticizer generally utilized in conventional HMX composite propellants. The resulting propellant not only produces a minimum amount of smoke during propulsion but, also, shows a significant and unexpected improvement in specific impulse characteristics.

SUMMARY OF THE INVENTION

In accordance with this invention, there is provided a novel family of azidonitrocarbamates which are energetic liquids and find particular utility as energetic plasticizers in advanced solid propellants. 1,3-Diazido-2-propyl-N-nitro-N-trinitropropyl carbamate (DANTC) is an example of this family of carbamates which have been found to be unexpectedly effective in overcoming the problem of smoke in the exhaust gases produced during the operational phase of a solid propellant composition. The energetic plasticizers of this invention replace the conventional inert plasticizers and are added to the propellant composition in a ratio of from about 1.5 to 4.0 parts of plasticizer to about 1.0 part of binder. The resulting propellant exhibits a significant increase in energy coupled with a minimum production of smoke.

Accordingly, the primary object of this invention is to provide a novel family of azidonitrocarbamates.

Another object of this invention is to provide a novel solid propellant composition that produces only minimum amounts of smoke during propulsion.

Still another object of this invention is to provide a novel family of azidonitrocarbamates that find particular utility as energetic plasticizers for advanced solid propellant compositions.

The above and still other objects and advantages of the present invention will become more readily apparent upon consideration of the following detailed description thereof.

DESCRIPTION OF THE PREFERRED EMBODIMENTS

With the above-mentioned and other objects in mind, the present invention contemplates the synthesis of a novel family of azidonitrocarbamates and their utilization as energetic plasticizers in conventional HMX containing solid composite propellants. This novel family of amines includes 1,3-diazido-2-propyl-N-nitro-N-trinitropropyl carbamate (DANTC) as a specific example. DANTC possesses physical properties that make it suitable for plasticizer use and is considerably more attractive than a conventional plasticizer such as (2,2,2-fluorodinitroethyl) formal (FEFO). Compared to FEFO, the DANTC has higher energy (+39 versus −178 kcal/mole), lower freezing point (−2° to 7° C. versus ±14° C.), and lower weight loss for 72 hours at 145° C. (2.9 versus 9.4%).

The synthesis of 1,3-diazido-2-propyl-N-nitro-N-trinitropropyl carbamate (DANTC) is shown by the following equation:

$$(NO_2)_3CCH_2CH_2NCO + HOCH(CH_2N_3)_2 \longrightarrow (NO_2)_3CCH_2-CH_2NHCO_2CH(CH_2N_3)_2 \xrightarrow[AC_2O]{HNO_3} (NO_2)_3CCH_2-CH_2N(NO_2)CO_2CH(CH_2N_3)_2$$

Example 1, as follows, discloses the experimental details of the reaction illustrated by the above equation.

EXAMPLE 1

1,3-Diazido-2-propyl-N-nitro-N-trinitropropyl carbamate (DANTC)

To a mixture of 25 mls of 98% nitric acid and 35 mls of methylene chloride was added dropwise 25 mls of acetic anhydride keeping the temperature at 0°–10° C. At this temperature there was then added dropwise 9.4 g (0.026 mole) of 1,3-diazido-2-propyl trinitropropyl carbamate. The reaction mixture was stirred at 0°–10° C. for an additional 1½ hours, after which time it was poured onto ice. The layers were separated and the aqueous portion was extracted with 50 mls of methylene chloride. The combined organic portion was then washed three times with ice water, dried over $MgSO_4$, and concentrated to yield 10.7 grams of crude 1,3-diazido-2-propyl-N-nitro-N-trinitropropyl carbamate. Pure product was obtained via liquid chromotography using silica gel as the absorbent.

Elemental Analysis:

| | C | H | N |
|---|---|---|---|
| Calculated for $C_7H_9N_{11}O_{10}$: | 20.64 | 2.23 | 37.86 |
| FOUND: | 20.60 | 2.34 | 37.86 |

The reaction scheme for producing the 1,3-diazido-2-propyl trinitropropyl carbamate (DATC) reaction component of Example 1 is shown in example 2.

EXAMPLE 2

1,3-Diazido-2-propyl trinitropropyl carbamate (DATC)

A mixture of 11 g (0.05 mole) of 3,3,3-trinitropropyl isocyanate, 7.1 g (0.05 mole) of 1,3-diazido-2-propanol, and 50 ml of ethylene dichloride was heated at reflux for four days. The reaction mixture was cooled and concentrated to yield 19 grams of crude 1,3-diazido-2-propyl trinitropropyl carbamate. Pure material was obtained via liquid chromatography using neutral alumina as the absorbent. Its structure was confirmed by ir, gc, and element analyses. The properties of DANTC are summarized in Table 1 as follows:

TABLE I

PROPERTIES OF DANTC

NAME: 1,3-Diazido-2-propyl-N-nitro-N-trinitropropyl carbamate
CODE: DANTC
STRUCTURE: $(NO_2)_3CCH_2CH_2N(NO_2)$-$CO_2CH(CH_2N_3)_2$
FORMULA: $C_7H_9N_{11}O_{10}$
MOLECULAR WEIGHT: 407
FREEZING POINT (C): 2 to 7 (glasses)
DENSITY (g/cc): 1.56
REFRACTIVE INDEX
(23° C.): 1.5203
IMPACT SENSITIVITY
(in/lbs): 5
WEIGHT LOSS (%): DANTC: 2.9
(72 Hrs 165° F.) FEFO: 9.4
$\Delta F_f$(Kcal/mole): +39
ELEMENTAL ANALYSES:

| | C | H | N |
|---|---|---|---|
| Calc'd for $C_7H_9N_{11}O_{10}$: | 20.04 | 2.23 | 37.84 |
| Found (%) | 20.00 | 2.34 | 37.86 |

The unexpected benefits achieved by replacing the inert plasticizer commonly employed in HMX/polyester based solid propellants with the novel energetic liquid plasticizers of this invention is further illustrated in table II. Although an HMX oxidizer and a polyester resin binder are preferred, other conventional oxidizing and resinous binders may be utilized, if desired, as well as other fuel components, such as powdered aluminum.

Solid propellant compositions are well known and since the basic preparation and constituent ingredients of the propellant compositions of this invention are not significantly altered or critical to the execution of the invention, with the exception of the energetic plasticizer component, a detailed explanation of the propellants preparation is not deemed necessary. The plasticizers of this invention are liquid in nature and are incorporated into the solid propellant mix in a conventional manner at any stage of processing prior to cure. Generally, however, it is incorporated into the propellant mix before all the solid ingredients have been added. The resulting solid propellant differs from a conventional composition only in the essential replacement of the typical inert plasticizer with the novel energetic plasticizers of this invention.

TABLE II

EFFECT OF SUBSTITUTING DANTC FOR TRIACETIN (TA) IN A HMX SMOKELESS PROPELLANT

| Propellant Composition (Weight %) | | |
|---|---|---|
| HMX | 75 | 75 |
| R-18 | 10 | 10 |
| TA | 15 | — |
| DANTC | — | 15 |
| Theoretical Performance ($P_c$ = 1000 + 14.7 psi) | | |
| $I_{sp}$ (lb-sec/lb) | 211 | 242 |

Of particular interest in the above propellants is the fact that the specific impulse increase, which is effected by such a substitution is 31–35 lbf-sec/lbm—a significant improvement. The ratio of plasticizer to binder of 1.5 to 1.0 can be increased up to 4.0 to 1.0 with a further increase in energy gain.

While the present invention has been described by reference to particular embodiments thereof, it should be understood by those skilled in the art that all the modifications that are encompassed within the scope of the appended claims are intended to be included herein.

What is claimed is:

1. A solid composite type propellant composition comprising a cured intimate mixture of:
   A. an oxidizer component consisting essentially of cyclotetramethylene tetranitramine;
   B. a synthetic resinous binder component consisting essentially of a polyester resin; and
   C. 1,3-diazido-2-propyl-N-nitro-N-trinitropropyl carbamate as an energetic plasticizer present in a ratio ranging from about 1.5 to 4.0 parts of plasticizer to about 1.0 part of polyester resin binder.

* * * * *